United States Patent [19]

Squires

[11] 4,004,350

[45] Jan. 25, 1977

[54] TREATING GAS AND FINE GRANULAR MATERIAL IN PANEL BED

[76] Inventor: Arthur M. Squires, 245 W. 104 St., New York, N.Y. 10025

[22] Filed: Aug. 28, 1974

[21] Appl. No.: 501,275

[52] U.S. Cl. ..... 34/33; 34/168; 55/96; 55/98; 55/282; 55/350; 55/479

[51] Int. Cl.[2] ..... F26B 3/00

[58] Field of Search ..... 55/96, 282, 99, 302, 55/350, 474, 479, 512–519; 34/33, 168

[56] References Cited

UNITED STATES PATENTS

| | | | |
|---|---|---|---|
| 3,296,775 | 1/1967 | Squires | 55/96 |
| 3,912,466 | 10/1975 | Zenz | 55/96 |

FOREIGN PATENTS OR APPLICATIONS

| | | | |
|---|---|---|---|
| 216,675 | 6/1975 | United Kingdom | 55/47 |

*Primary Examiner*—Bernard Nozick

[57] ABSTRACT

There is provided an improved panel bed gas-solid contactor fitted for puffback cleaning and for use with a relatively fine granular material, such as smaller than about 20 mesh, at large gas face velocities (i.e., the horizontal velocity of gas across the panel bed), in which the fine material is prevented from blowing away from gas exit portions of the panel bed by mounting a column of closely spaced louvers next to these portions, providing a second column of substantially horizontal louvers spaced apart from the closely spaced louvers, and filling the space between the two louver columns with a coarser granular material, such as 10–14 mesh. The coarser material is also preferably denser. The contactor is well suited for use at elevated temperatures.

9 Claims, 7 Drawing Figures

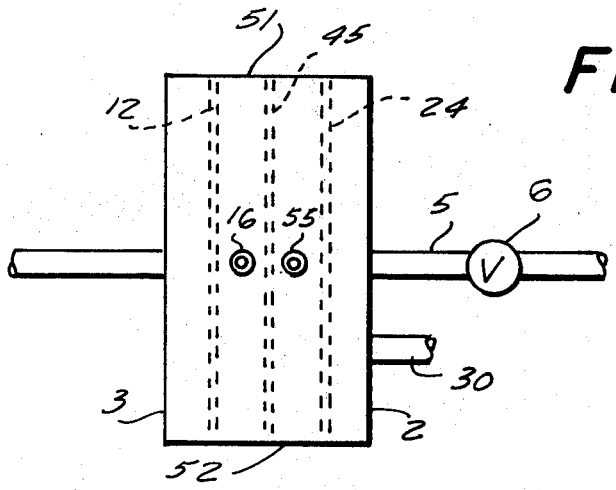
FIG. 2
FIG. 3
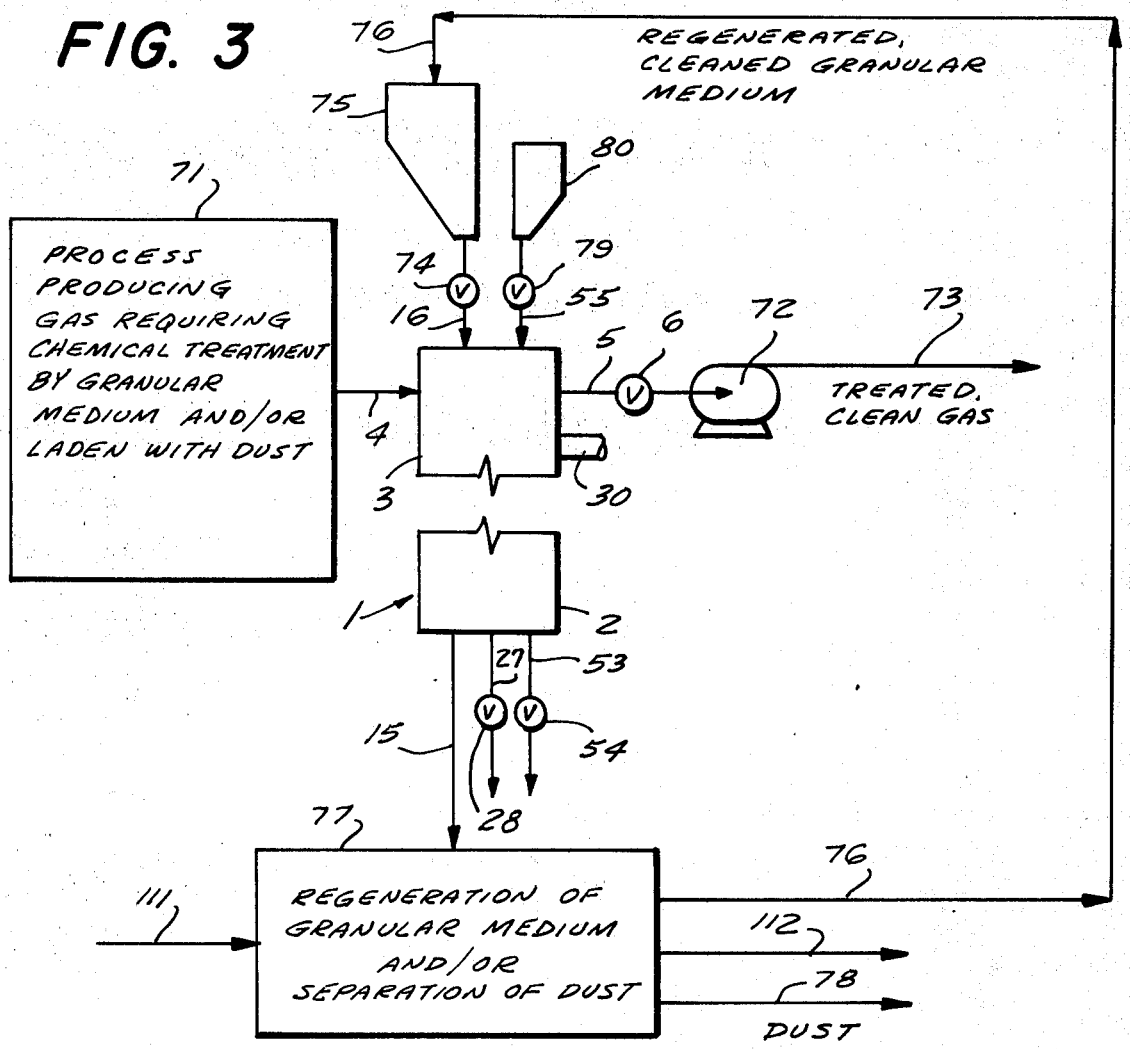

TREATING GAS AND FINE GRANULAR MATERIAL IN PANEL BED

CROSS-REFERENCE TO RELATED APPLICATIONS

This application is related to my co-pending applications, filed simultaneously herewith, numbered and entitled as follows:

1. Treating Gas and Granular Material in Panel Bed, Ser. No. 501,276.
2. Filtering Dusty Gas in Improved Panel Bed Ser. No. 501,278.
3. Countercurrent Contacting of Gas and Granular Material in Panel Bed Ser. No. 501,277

The instant application is the fourth of this sequence.

FIELD OF THE INVENTION

The invention relates to the intimate contacting of a gas and a fine granular solid material for the purpose of chemically or physically treating one or both of these substances, for example, to filter a dust from the gas or to effect a chemical change in gas or solid or to remove a chemical constituent of the gas by aborption or adsorption or to heat a cold gas by contact with a hot solid. Specifically, contact is improved by providing for use of a fine solid at high gas velocities such as would ordinarily blow away the fine solid.

DESCRIPTION OF THE PRIOR ART

My aforementioned co-pending application number 1, "Treating Gas and Granular Material in Panel Bed," furnishes a review of prior art relating to panel beds, with emphasis upon art relating to techniques for removing "Spent" granular material, together with filtered dust if any is present, from fluid/entry surfaces of such panels. I incorporate this review in the instant application by reference.

British Pat. No. 216,675 (June 5, 1924) disclosed a panel bed arrangement for filtering a dusty gas in which a fine filtration solid was held in a first bed having a gas entry face of louvers mounted in form of a venetian blind. Behind the first bed was a second bed of a coarser solid having a gas exit face of similar louvers. Inbetween and separating the two beds was a column of vertically spaced louvers in the form of inverted V's. Filtration solid together with collected dust was withdrawn from the bottom of the first bed, and solid could also be drained, if desired, from the second bed.

My earlier U.S. Pat. No. 3,296,775 (Jan. 10, 1967) taught a reverse surge flow of gas across a panel bed to produce a movement of the granular material in a mass toward the outer edges of louvers supporting gas entry faces, effecting a spill of the material from each face, and removing filter cake if present. The surge flow was to peak sharply to a flow substantially above the minimum steady flow rate at which a steady reverse flow of gas just causes motion of the granular material, and thereafter was to decline substantially immediately.

My aforementioned co-pending application number 1, "Treating Gas and Granular Material in Panel Bed," provides a more particular characterization of a reverse transient flow to produce a movement of granular material in mass (a "body movement") toward the gas entry faces of a panel bed.

For convenience of reference, I use the term "puffback" for the reverse transient flow of gas specified in my aforementioned co-pending application number 1, whereby used-up granular medium, including accumulated filtered dust, if any, is removed from the panel bed. My co-pending applications number 2 and 3 provide new panel bed designs particularly suited to be fitted for puffback cleaning.

GENERAL DESCRIPTION OF THE INVENTION

I have found that in panel beds fitted for puffback cleaning, better performance in filtering typical power-station fly ash is obtained at higher face velocities (the velocities of gas being filtered horizontally across the panel) and with finer granular filtration solid, preferably finer than 20 mesh (U.S. Standard). Better performance is also obtained for a finer solid material in a gas treatment for purpose of bringing about a chemical change or for bringing about a heating or cooling of the gas.

A problem arose because at higher face velocities the finer solids of preference tended to be blown away from gas exit portions of the panel bed.

For applications at or near atmospheric temperature, the fine solid of a panel bed may advantageously be retained by a fine wire-mesh screen or by such a screen backed by a felt cloth, but this arrangement is not attractive in applications at substantially elevated temperature, such as beyond above 500° F and especially beyond about 1,000° F and especially in a gas that is corrosive with respect to metals suitable for fabricating into a wire mesh.

I attempted to use substantially the aforementioned arrangement of British Pat. No. 216,675, but the attempt was not successful in producing a useful result. During puffback, the second bed of coarser solid participated to a small degree in the body movement induced by puffback, and after several puffback cleanings, coarse solid appeared in the first bed and even reported in the spilled granular solid at lower gas entry faces of the panel. This experience taught me that it was essential to prevent the coarser solid from entering the treating bed of finer solid, as well as to prevent the finer solid from being blown away by the gas being treated.

I have discovered an improvement upon the British Pat. No. 216,675 arrangement, especially suited for a panel bed fitted for puffback cleaning, in which the aforementioned spaced-apart inverted V's are replaced by a column of closely spaced louvers. If the spacing of the louvers is approximately the dimensions of the coarse particles of the gas exit bed, these particles do not penetrate the fine particles of the gas entry, gas treating bed upon application of the puffback.

OBJECTS OF THE INVENTION

An object of the invention is to provide an improved method and apparatus for the chemical and physical treatment of at least one of a gas and a granular medium brought into contact.

Another object is to provide an improved method and apparatus for bringing a gas and a granular solid into intimate contact at an elevated temperature.

Another object is to provide a filter for dusty gas.

Another object is to provide a filter for gas at elevated temperature of high gas-treating capacity.

SUMMARY OF THE METHOD FEATURES OF THE INVENTION

My invention relates to an improved method of contacting gas and a fine granular material with each other to effect physical or chemical treatment of at least one of them. The fine granular material is arranged in a bed having a plurality of transversely disposed, upwardly spaced, gas entry portions separated by interposed supporting members having outer and inner edges. The gas entry portions have gas entry faces having outer edges that are substantially contiguous with the outer edges of the supporting members. The bed has gas exit portions spaced horizontally apart from the inner edges of the supporting members. A second bed of a second, coarser granular material is arranged to have a plurality of transversely disposed upwardly spaced gas exit portions separated by interposed supporting members. The two beds are separated by transversely disposed upwardly spaced louvers that support the aforementioned gas exit portions of the first bed, and also that support gas entry portions of the second bed. The upward spacing between adjacent louvers is, substantially everywhere along their width in the transverse direction, about the dimension of a typical particle of the coarser granular material. Gas is caused to flow forwardly in a substantially continuing flow during the aforementioned treatment through the gas entry portions of the first granular material bed and outwardly from the gas exit portions of this bed to effect treatment of gas or granular material or both. Gas further flows through the gas entry portions of the second granular material bed and outwardly from the gas exit portions of this bed. Thereafter, a transient flow of gas is caused to move in the direction in reverse to the aforementioned flow of gas. The transient reverse flow produces first a rise (at a given rate of rise) and subsequently a fall in the pressure difference between the gas exit portions of the second bed and the gas entry portions of the first bed. This difference should remain greater than a first critical minimum difference for a time interval of less than about 150 milliseconds, this first critical minimum difference being that difference at which a steady flow of gas in the aforementioned reverse direction just produces a localized spill of granular material from the gas entry faces of the first bed. The pressure difference produced by the transient reverse flow should peak to a top value beyond a second critical minimum difference, which is the pressure difference at which a transient flow of gas in the reverse direction, producing the second critical minimum difference at the aforementioned given rate of rise, just initiates a body movement of the first granular material toward the gas entry faces of the first bed to spill a portion of this granular material from the bed. The second granular material does not participate in the body movement on account of the aforementioned dimensional relationship between the upward spacing between the adjacent louvers and the typical particle of the second granular material. The second critical minimum pressure difference depends upon the rate of rise in the pressure difference, being larger the more rapid the rise. The aforementioned time interval is sometimes advantageously less than about 50 milliseconds, especially for use of the invention to filter dust from a gas.

The second, coarser granular material is sometimes preferably closely sized, i.e., displaying a narrow range of size, for greater porosity. The second, coarser material is advantageously of higher density than the first material, so that as large a flow of gas as possible may traverse the two beds without danger of spilling the second material from the gas exit portions of the second bed.

For convenience of reference, I sometimes use the term "reverse puff" or "puffback" for the specified reverse transient flow of gas. The term "puffback" denotes broadly my new cleaning technique, explicated more fully in my aforementioned co-pending application number 1, whereby a panel bed is rid of solid "spent" or used up by a gas-solid contacting procedure, together with dust captured by filtration along with some of the spent solid, if the panel bed has been employed as a gas filter.

SUMMARY OF THE APPARATUS FEATURES OF THE INVENTION

My invention also relates to an improved gas-solid contactor with a trio of upwardly extending, horizontally spaced-apart, perforate retaining walls, with means for supplying a first loose solid particulate material into the space between the first and second perforate walls, and with means for supplying a second, coarser loose solid particulate material into the space between the second and third walls. There is a plurality of particulate-material support members each adjacent a perforation of the first perforate wall, each member being arranged to extend outwardly from below its adjacent peforation and into an inlet compartment in communication with the perforations of the first wall. There is a plurality of particulate-material support members each adjacent a perforation of the third perforate wall, each member being arranged to extend outwardly from below its adjacent perforation and into an outlet compartment in communication with the perforations of the third wall. The support members of the first wall are arranged cooperatively to support the first particulate material and retain the material within the space between the first and second perforate walls, and they are arranged to support and expose to the inlet compartment a plurality of free surfaces of the first particulate material. The support members of the third wall are arranged cooperatively to support the second particulate material and retain the material within the space between the second and third perforate walls, and they are arranged to support and expose to the outlet compartment a plurality of free surfaces of the second particulate material. There is a plurality of support louvers each adjacent a perforation of the second perforate wall, these support louvers being arranged so that the separation between each pair of adjacent louvers is substantially everywhere at a distance about equal to the dimension of a typical particle of the second particulate material. There is an inlet for admitting a gas into the inlet compartment for passage into the free surfaces of the first particulate material and through both particulate materials and from the free surfaces of said second particulate material to the outlet compartment, and there is an outlet for discharging gas from the outlet compartment. Means are provided for periodically effecting a body movement of the first particulate material toward the inlet compartment of at least those portions of the particulate material including the free surfaces of the first particulate material and which are retained on the support members of the first perforate wall. The body movement means comprises means for effecting a transient flow of gas from gas outlet compartment to gas inlet compartment that produces first a rise and subsequently a fall in the pressure difference between the gas outlet compartment and the gas inlet compartment, the pressure difference remaining greater than the aforementioned first critical minimum difference for less than about 150 milliseconds and also peaking beyond the aforementioned second critical minimum difference.

A preferred means for effecting the transient flow of gas is a source of gas under pressure and means for effecting a sudden discharge of gas from the pressure source into the outlet compartment, with volume control means for limiting the quantity of gas discharged.

Other preferred means for effecting the specified transient flow of gas are disclosed in my aforementioned co-pending application number 1, and are incorporated herein by reference.

BRIEF DESCRIPTION OF THE DRAWINGS

The invention will be more particularly described in conjunction with the following drawings wherein:

FIG. 2 is a top view of the panel of FIG. 1;

FIG. 3 is a schematic diagram illustrating use of the invention to produce chemical treatment of a gas by a granular medium, including a gas laden with dust;

DESCRIPTION OF THE PREFERRED EMBODIMENTS

Figure 1:
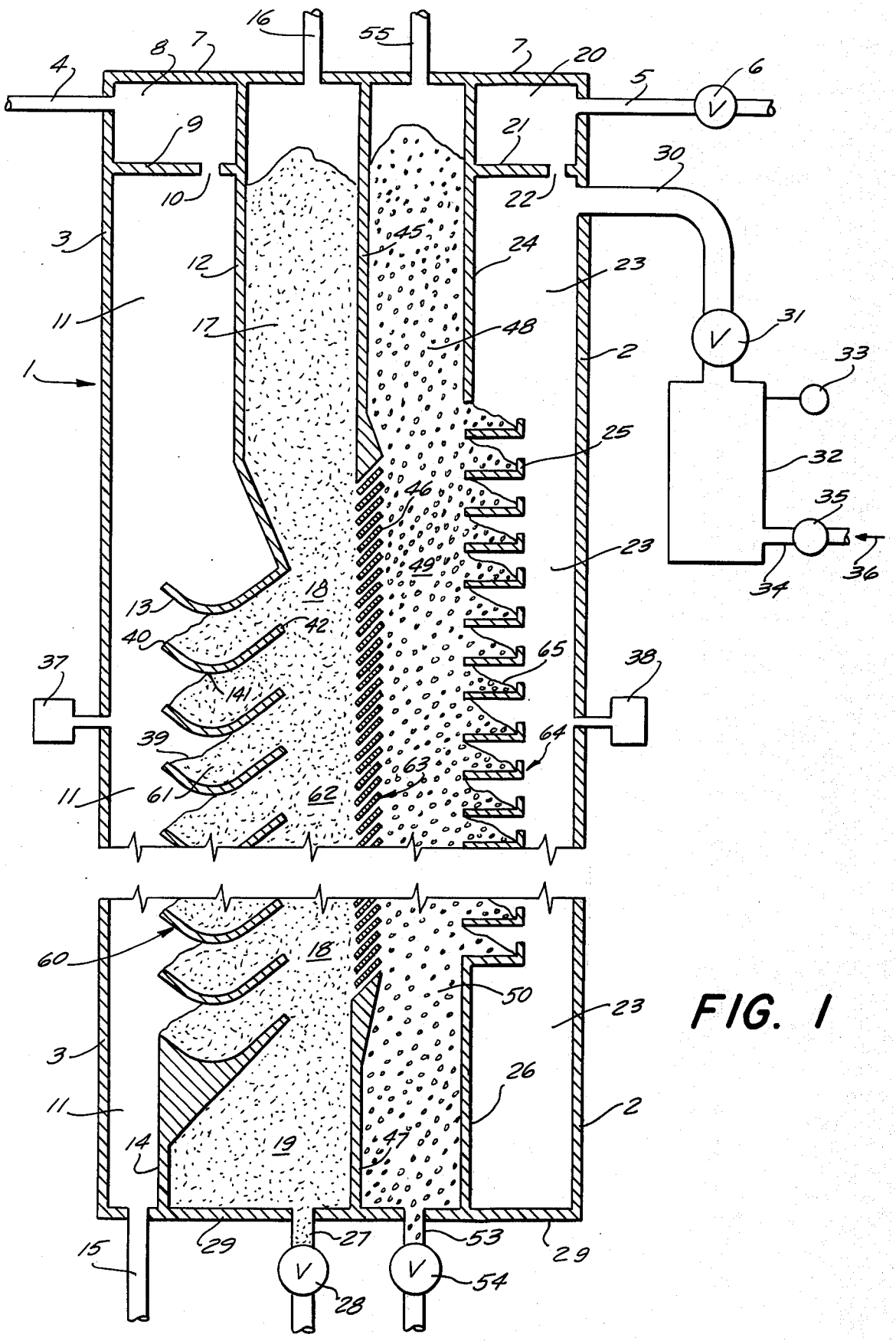
FIG. 1 is a vertical section view of a preferred panel bed gas-solid contactor, with a bed of contacting solid.

In the several figures, like reference numerals refer to like parts having like functions. In FIG. 1 the panel bed gas-solid contactor 1 comprises a casing of rectangular cross-section having opposed side walls 2 and 3 and top plate 7 and bottom plate 29. Opposed edge walls 51 and 52 are to be seen in FIG. 2, a top view. A generally vertical bed of granular contact solid 18 is within the casing and retained by vertically extending, horizontally spaced-apart, perforate walls 60 and 63. Granular material is supplied by gravity feed to bed 18 from supply bed 17, retained between imperforate walls 12 and 45. Additional granular material may be added to bed 17 from pipe 16. Granular bed 18 may be drained, if desired, via space 19 between walls 14 and 47, normally filled with static granular solid, by means of pipe 27 and valve 28. Perforate wall 63 comprises a series of inclined louvers or slats 46 mounted one above another in a structure resembling a venetian blind and narrowly spaced apart in the vertical direction. Horizontally spaced-apart from wall 63 is perforate wall 64 comprising a series of generally horizontal louvers or slats 25 also mounted one above another. Granular material bed 49, comprising material considerably coarser in size than the granular contact solid of bed 18, and also preferably denser than the contact solid, is retained by perforate walls 63 and 64, and is supplied from supply bed 48, retained between imperforate walls 45 and 24. Additional granular material of the coarser character may be added to bed 48 from pipe 55. Granular bed 49 may be drained, if desired, via space 50 between walls 47 and 26, normally filled with static granular material, by means of pipe 53 and valve 54. Walls 12, 60, 14, 3, 51, and 52, bottom 29, and partition 9 enclose gas entry compartment 11, to which gas to be treated is supplied from pipe 4 via plenum space 8 and slot 10 in partition 9 (the slot 10 preferably extending from wall 51 to wall 52). Walls 24, 64, 26, 2, 51, and 52, bottom 29, and partition 21 enclose gas exit compartment 23, from which gas leaves via slot 22 in partition 21 (the slot 22 preferably running from wall 51 to wall 52) and via plenum space 20 and pipe 5. Louvers 25 cooperate to support gas exit surfaces 65 of bed 49.

Perforate wall 60 comprises a series of members 13. A member 13 typically inclines outwardly and downwardly from its inner edge 42 and then upwardly and into inlet compartment 11 toward its outer edge 40. The curvature of member 13 should be gentle, that is to say, there should be no sharp corners and no pockets or protuberances to interfere with the body movement of gas entry portions 61 of bed 18. The perforations of wall 60 are to be considered as being formed between respective inner edges 42 of adjacent members 13. The members 13 are mounted in a manner such that they cooperate to support gas entry portions 61, viz., a line drawn through edge 40 of a given member 13 at an angle of about 25° from the horizontal and upwardly toward the next superjacent member 13 should intersect the superjacent member, so that gas entry surface 39 borne by the given number 13 will display an inner edge 141 in contact with the superjacent member. It will be seen that the gas entry portions 61 are transversely disposed, upwardly spaced, and separated by the interposed supporting members 13, the gas entry faces 39 being substantially contiguous with outer edges 40. A line drawn through inner edge 141 of a given gas entry face 39 and the inner edge 42 of its supporting member 13 should be inclined at an angle less than about 45° from the horizontal, if inner support member edge 42 is below inner gas entry surface edge 141, as is the case in FIG. 1. Alternatively, edge 42 may lie above edge 141 (see the alternative design 213 for support members of wall 60 illustrated in FIG. 5).

Gas exit portions of bed 18 are seen at 62 in FIG. 1, and are spaced from edges 42.

Pipe 30 connects gas exit compartment 23 with tank 32, quick-opening valve 31 being provided to isolate tank 32 from space 23. Tank 32 is connected to source 36 of gas under pressure via line 34 and valve 35. Pressure gauge 33 is provided to help adjust the pressure of gas in tank 32.

In operation of panel bed contactor 1, the panel bed 1 is initially charged with granular contact solid from line 16, filling spaces 19, 18, and 17 as shown in FIG. 1. A second, coarser granular material is charged to spaces 50, 49, and 48 from line 55. Panel bed 1 may be connected, for example, to a process 71 producing a gas requiring chemical treatment by a granular medium, as shown in FIG. 3, and the panel bed contactor 1 of the instant invention affords the advantage that the gas to be treated chemically may also be dusty, whereupon panel bed contactor 1 acts both to treat the gas and to rid it of dust. The gas is caused to flow forwardly through panel bed 1 by opening valve 6 in pipe 5. If process 71 does not produce gas at sufficient pressure to cause the gas to flow readily through panel bed 1, optional blower 72 is conveniently provided to carry gas from pipe 5 to line 73 for conducting treated gas from the system. Periodically, tank 32 is filled with gas at pressure from supply 36, valve 35 is closed, valve 6 is closed to interrupt the flow of gas being treated and valve 31 is opened quickly to produce the specified transient reverse flow from compartment 23 to compartment 11. Pipe 15 is provided to withdraw solid removed from bed 18 by the puffback cleaning. The frequency of puffback cleaning is preferably regulated so that the withdrawn solid is essentially "used up" by the chemical treatment of the gas, i.e., lacking any further virtue for chemically treating the gas, i.e., "spent." Such regulation is also best regulated so that solid in bed 18 between edges 42 and perforate wall 63 does not participate in the chemical treatment, i.e., the locus of treatment should remain entirely within gas entry portions 61 of the bed 18, lying between edges 40 and 141 and the vertical plane defined by edges 42. As seen in FIG. 3, pipe 15 sometimes advantageously conducts the spilled solids to means 77 for "regenerating" the spent solid, i.e., restoring its virtue for the intended chemical treatment of the gas, as may often be accomplished by contacting the spent solid with a fluid from line 111 with the generation of a discharge fluid removed from step 77 via line 112. Step 77 also conveniently includes separation of dust for removal via line 78, if any dust has been filtered from the gas undergoing chemical treatment. Pipe 76 is conveniently provided for return of regenerated contact solid to supply hopper 75, from which the solid may be returned to panel bed 1 via valve 74 and pipe 16. Alternatively, if regeneration of the spent solid is not desired, it may be discarded, and fresh granular contact solid may be supplied to hopper 75. Supply hopper 80 may conveniently be provided to hold the aforementioned second, coarser granular material in readiness for supply to spaces 48, 49, and 50 via valve 79 and pipe 55. After passage of the specified transient reverse flow and after waiting a few seconds for falling solid matter to settle to the bottom of compartment 11, valve 31 is closed, and valve 6 is opened to resume treatment of the pressure by the freshly cleaned bed 18.

Transducers 37 and 38 are conveniently provided in a test to determine the aforementioned first and second critical minimum pressure differences between space 23 and space 11, although competent fluid dynamicists will be able to calculate instantaneous pressure difference versus time in a test of puffback, given the porosity of beds 18 and 49, the size of valve 31, the speed of its opening, the size of tank 32, the pressure therein, the length and the diameter of line 30, and the dimensions of compartment 23.

Tests for determining the critical pressure differences and illustrating the suitable limits on the time interval during which the puffback maintains the reverse pressure difference greater than the first critical minimum difference are discussed more fully in my aforementioned co-pending application number 1, together with representative data, and this discussion is incorporated herein by reference.

In brief, a time interval of about 150 milliseconds represents an approximate upper limit for acceptable performance, and I prefer a time interval below 100 milliseconds and preferably below 50 milliseconds for use of the panel bed 1 as a filter. At a time much longer than 150 milliseconds, the granular material movement took on much more of the character of the localized spill and less of the preferred body movement, and the distribution of the spill from gas entry surfaces 39 became poor, there being a much larger spill from the top surfaces than from the bottom. A practical minimum time interval for operation of the arrangement of FIG. 1 appears to be about 3 to 5 milliseconds, given the practical requirement that space 23 must be large enough to accomodate a flow of gas leaving wall 64. It should be noted, however, that one might, for example, achieve an extremely short time interval by mounting a large number of blank cartridges on wall 2 and firing them simultaneously to discharge gas explosively into space 23.

Figure 4:
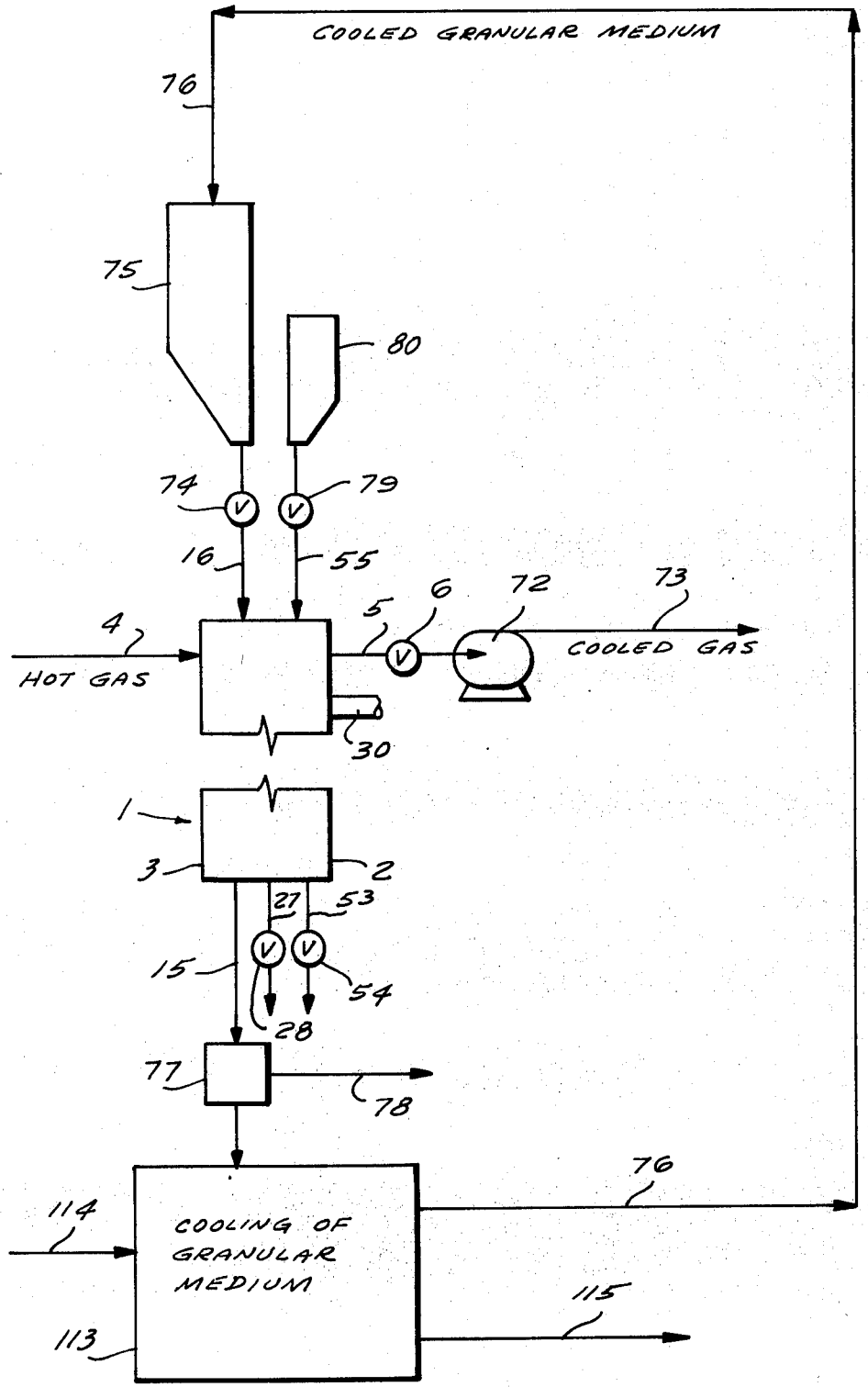
FIG. 4 is a schematic diagram illustrating use of the invention to cool a hot gas by heat exchange against a cold granular medium.

FIG. 4 illustrates how panel bed 1 may be used to cool a hot gas by countercurrent contact with a cold granular solid medium, with the advantage that the hot gas may be dusty, in which case, dust is removed from the system via line 78, as before in FIG. 3. The cooled granular medium from pipe 15 may advantageously give up its heat to an operation requiring heat, as at 113, for example, by heating a cold fluid supplied to 113 from line 114 to provide a hot fluid via line 115.

The panel bed contactor of the instant invention affords countercurrent gas-solid contacting equipment of outstandingly small size and at outstandingly small gas pressure loss (typically below 20 centimeters of water). Gas velocities in the horizontal direction across bed 18 in excess of 30 feet per minute are preferred, and overall gas-treating capacities of more than 600 cubic feet per minute per square foot of ground area occupied by the panel bed device are readily provided. The panel bed contactor also has the advantage of being capable of treating a gas with a contact solid of outstandingly small size. Gravitating beds of the type ordinarily used in the art for countercurrent gas-solid contacting commonly use particles larger and ⅛ inch in size and often use particles larger than 1 inch. I prefer to use a fine granular contact solid smaller than about 10 mesh (U.S. Standard), and frequently it is advantageous to use a solid smaller than about 20 mesh or a solid smaller than about 40 mesh. Generally speaking, I prefer a contact solid larger than about 100 mesh. The smaller contact solid sizes have the advantage that there is less loss of solid because of the production of fines due to attrition when such smaller solids are handled and moved about in conventional systems for conveying solids pneumatically.

Figure 5:
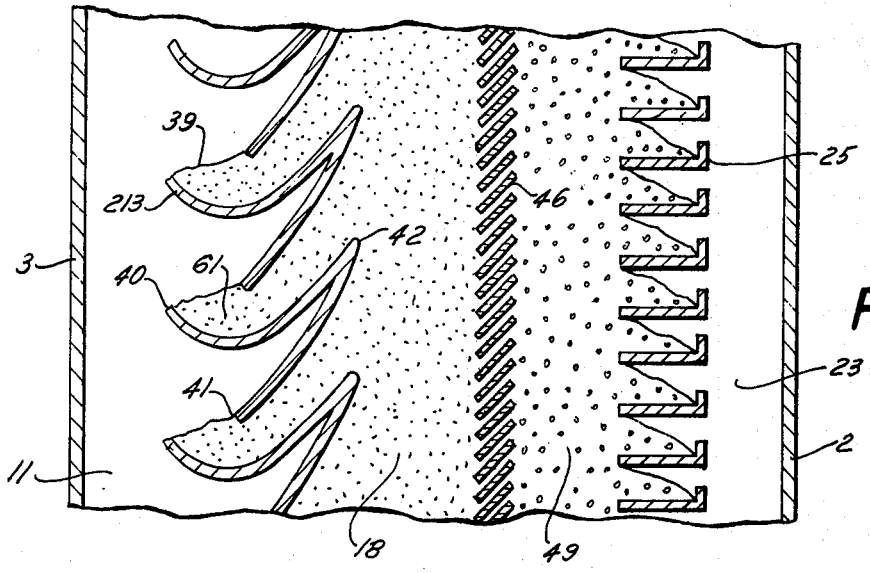
FIGS. 5 through 7 are detail views of alternative preferred panel bed contactors.
Figure 6:
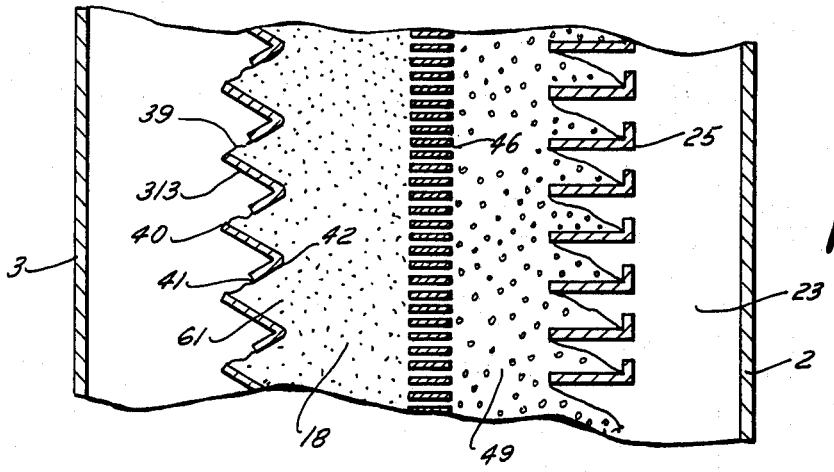
Figure 7:
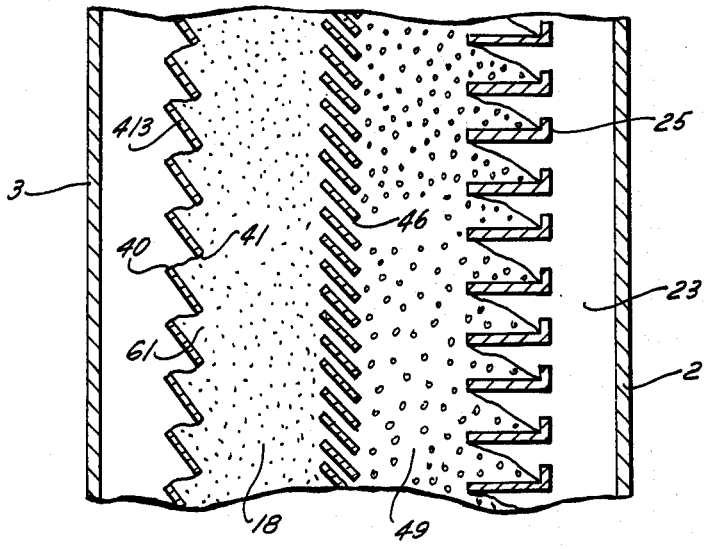

FIGS. 5 through 7 illustrate alternative designs 213, 313, and 413 for the support members of perforate wall 60 that may advantageously be provided for various contacting purposes. Design 213 in FIG. 5 is particularly useful in a panel bed contactor subject to fluctuations in temperature during operation, since the space between upper surface of typical member 213 (displaying outer edge 40) and lower surface (displaying outer edge 41, substantially contiguous with inner edge of gas entry face 39) provides room for thermal expansion and contraction. Design 413 of FIG. 7 is suitable for filtering a gas, and design 313 of FIG. 6 is preferred for gas filtration by a tall panel bed (see discussion of this design in my aforementioned co-pending application number 2, "Filtering Dusty Gas in Improved Panel Bed").

FIGS. 5 through 7 also show alternative orientations of the louvers 46 of perforate wall 63. In general, I prefer an oriention of these louvers in the general direction by which the contact solid undergoing the body movement of the invention enters gas entry portions 61 borne by support members 13, 213, 313, or 413 of perforate wall 60. This is not critical, however, for I find that other orientations give satisfactory results.

I have experimented with an arrangement like that shown in FIG. 6, in which louvers 46 were horizontal, each louver being 0.024 inches thick, ⅜ inch wide in the transverse direction, and each pair of louvers was separated vertically by a distance of 0.080 inches. I obtained good performance of the arrangement at face velocities up to about 100 feet per minute (the velocity in the horizontal direction across the panel bed) and with both 20–30 and 40–50 mesh (U.S. Standard) quartz sand in bed 18. I used 10–14 mesh quartz sand in bed 49 (i.e., sand particles that passed through screen openings of about 0.0787 inches and were retained by screen openings of about 0.0555 inches. The arrangement of louvers 46 prevented the larger sand from participating in the body movement of bed 18, thereby undesirably causing the larger sand to enter bed 18 traversing perforate wall 63, during hundreds of puffback cleanings.

For the same combinations of sand, I experimented with an arrangement like that seen in FIG. 5, with inclined louvers 46. Each louver 46 was inclined at 50°, was 0.583 inches wide in the direction of the inclination, was separated from its two neighbors by a distance of 0.080 inches in the perpendicular direction thereto (i.e., by a distance of 0.124 inches in the vertical direction), and was 0.024 inches thick. Perforate wall 63 occupied a horizontal dimension of ⅜ inch. In this arrangement, small quantities of the 10–14 mesh sand held in bed 49 penetrated bed 18 during the body movement accompanying many repeated puffback cleanings. The performance was acceptable, for the small penetrations of 10–14 mesh sand could readily be removed from the sand spilled from bed 18 before this sand is returned to bed 18 (via step 77, pipe 76, bin 75, valve 74, and line 16 of FIG. 3, for example). However, in light of this experience, I prefer a somewhat narrower separation between louvers 46 when they are inclined, and I believe that a vertical separation of 0.080 inches would provide substantially perfect performance.

In operation of panel bed 1, it is preferable that valve 6 be opened slowly at the start of each gas-treating cycle, so that a sudden rush of gas into the bed 18 via surfaces 39 does not compact the bed and cause gaps to appear beneath the surfaces of members 13 inboard from edge 141.

The chemical nature of the contact solid for bed 18 is dictated by the treating process to be carried out in panel bed 1. The instant invention may be advantageously used for a variety of applications, for which examples are given in my aforementioned co-pending application number 3, "Countercurrent Contacting of Gas and Granular Material in Panel Bed," which examples are incorporated herein by reference.

It should be noted that the porosity of granular material bed 18 should be brought initially to the uniform porosity appropriate for the puffback intensity selected for operation, as discussed more fully in my aforementioned co-pending application number 1, "Treating Gas and Granular Material in Panel Bed." Specifically, it is advantageous to subject the panel bed initially to a "strong" puffback at an intensity exceeding that contemplated for subsequent operations, or to discharge a controlled quantity of sand from the bottom of the panel bed.

It will also be understood that when granular material is first charged to bed 18, it may sometimes be necessary to apply several puffbacks to advance gas entry surfaces to positions 39 contiguous with outer edges 40.

I do not wish my invention to be limited to the particular embodiments illustrated in the drawings and described above in detail. Other arrangements will be recognized by study of my aforementioned co-pending applications 1 through 3 and by those skilled in the art, as well as purposes other than those discussed herein which the invention can advantageously serve.

In my experiments with 40–50 mesh sand in bed 18 and 10–14 mesh sand in bed 49, I experienced an acceptably small penetration of the finer sand into the bed of coarser sand, viz., in continuous operation, the content of the finer sand within the coarser sand bed could be maintained at an acceptably low level by a small rate of replacement of the sand in bed 49. However, I believe that if a treating solid much finer than 40–50 mesh is used in bed 18, it will be advantageous to provide a fourth perforate wall with closely spaced louvers, so that three grades of sand can be used, the middle grade being retained between two walls like wall 63 and separating bed 18 and bed 49.

I claim:

1. A method of contacting gas and granular material with each other in a panel bed having loose gas-entry granular material faces supported by support members and fitted for cleaning and renewal of the faces by puffback to effect physical or chemical treatment of at least one of gas and granular material comprising:

a. arranging a first, fine granular material in a first bed having a plurality of transversely disposed upwardly spaced gas entry portions separated by interposed supporting members, said members having outer and inner edges with respect to the bed whereby said gas entry portions have gas entry faces substantially contiguous with said outer edges, and said first bed having gas exit portions spaced from said inner edges and said gas exit portions being supported by transversely disposed upwardly spaced louvers;

b. arranging a second coarser granular material than in (a) in a second bed next to said first bed, said second bed having a plurality of transversely disposed upwardly spaced gas exit portions separated by interposed supporting members spaced from the louvers of said first bed, said second bed having gas entry portions that are supported by said louvers and the upward spacing of said louvers being about the dimension of a particle of said coarser granular material so that said second material does not participate in the body movement of the fine granular material in the first bed that accompanies the action of puffback;

c. forwardly flowing gas in a substantially continuing flow during said treatment through the gas entry portions of said first granular material bed and outwardly from the gas exit portions of this bed and through the gas entry portions of said second granular material bed and outwardly from the gas exit portions of this second bed to effect said treatment of one of said gas and said first granular material;

d. thereafter causing a transient flow of gas to move in the direction in reverse to the flow of said gas in (c); and e. causing said transient reverse flow to produce first a rise at a given rate of rise and subsequently a fall in the pressure difference between said gas exit portions of said second bed and said gas entry portions of said first bed, said difference produced by said transient reverse flow remaining greater than a first critical minimum difference for a time of less than about 150 milliseconds, said first critical difference being that difference at which a steady flow of gas in said reverse direction just produces a localized spill of said first granular material from said gas entry faces of said first bed, and said difference produced by said transient reverse flow peaking to a top value beyond a second critical minimum difference, which is the pressure difference at which a transient flow of gas in said reverse direction producing said pressure difference at said rate of rise just initiates a body movement of said first granular material supported by said interposed members toward said gas entry faces of said first bed to spill a portion of said first granular material from the bed while said second granular material does not participate on account of the dimensional relationship between the upward spacing and the coarser particle.

2. The method of claim 1 in which said second, coarser granular material is closely sized.

3. The method of claim 1 in which said second, coarser granular material has a higher density than said first granular material.

4. A method of contacting gas and granular material with each other in a panel bed having loose gas-entry granular material faces supported by support members and fitted for cleaning and renewal of the faces by puffback to effect physical or chemical treatment of at least one of gas and granular material by means of a filter of granular material which comprises:

a. arranging a first, fine granular material in a first bed having a plurality of transversely disposed upwardly spaced gas entry portions separated by interposed supporting members, said members having outer and inner edges with respect to the bed whereby said gas entry portions have gas entry faces substantially contiguous with said outer edges, and said first bed having gas exit portions spaced from said inner edges and said gas exit portions being supported by transversely disposed upwardly spaced louvers;

b. arranging a second coarser granular material than in (a) in a second bed next to said first bed, said second bed having a plurality of transversely disposed upwardly spaced gas exit portions separated by interposed supporting members spaced from the louvers of said first bed, said second bed having gas entry portions that are supported by said louvers and the upward spacing of said louvers being about the dimension of a particle of said coarser granular material so that said second material does not participate in the body movement of the fine granular material in the first bed that accompanies the action of puffback;

c. forwardly flowing gas in a substantially continuing flow during said treatment through the gas entry portions of said first granular material bed and outwardly from the gas exit portions of this bed and through the gas entry portions of said second granular material bed and outwardly from the gas exit portions of this second bed to effect said treatment of one of said gas and said first granular material;

d. thereafter causing a transient flow of gas to move in the direction in reverse to the flow of said gas in (c); and e. causing said transient reverse flow to produce first a rise at a given rate of rise and subsequently a fall in the pressure difference between said gas exit portions of said second bed and said gas entry portions of said first bed, said difference produced by said transient reverse flow remaining greater than a first critical minimum difference for a time of less than about 150 milliseconds, said first critical difference being that difference at which a steady flow of gas in said reverse direction just produces a localized spill of said first granular material from said gas entry faces of said first bed, and said difference produced by said transient reverse flow peaking to a top value beyond a second critical minimum difference, which is the pressure difference at which a transient flow of gas in said reverse direction producing said pressure difference at said rate of rise just initiates a body movement of said first granular material supported by said interposed members toward said gas entry faces of said first bed to spill a portion of said first granular material from the bed while said second granular material does not participate on account of the dimensional relationship between the upward spacing and the coarser particle.

5. The method of claim 4 in which said second, coarser granular material is closely sized.

6. The method of claim 4 in which said second, coarser granular material has a higher density than said first granular material.

7. A gas-solid contactor comprising three upwardly extending horizontally spaced-apart perforate retaining walls, a gas inlet compartment adjacent and in flow communication with the perforations of the first of the perforate walls, a gas outlet compartment in flow communication with the perforations of the third of the perforate walls, closure means about a first space being the space between the first and second perforate walls and about a second space being the space between the second and third perforate walls closing said spaces against the passage of gas except through the perforations of said perforate walls, feed means for supplying a first loose solid fine particulate material into said first space, feed means for supplying a second, coarser loose solid particulate material in said second space, a plurality of support members each adjacent a perforation of said first perforate wall, said support members being arranged to extend outwardly from below their adjacent perforations and into the inlet compartment to support and expose to the inlet compartment a plurality of free surfaces of said first particulate material, said support members being arranged cooperatively to support the particulate material and retain the material within said first space, a plurality of support members each adjacent a perforation of said third perforate wall to support and retain said second particulate material within said second space, a plurality of support louvers each adjacent a perforation of said second perforate wall, said support louvers being arranged so that the separation between each pair of adjacent louvers is substantially everywhere at a distance about equal to the dimension of a particle of said second particulate material, an inlet for admitting a gas into the inlet compartment for passage into the free surfaces of said first particulate material and through both particulate materials and into the outlet compartment.

an outlet for discharging gas from the outlet compartment, means for periodically effecting a body movement toward the inlet compartment of at least those portions of said first particulate material including said free surfaces and particles which are retained on said support members of said first perforate wall, said body-movement means comprising means for effecting a transient flow of gas into said outlet compartment, thence across the three perforate walls, through said both particulate materials in the two spaces, from said free surfaces of the first particulate material into the inlet compartment to produce first a rise and subsequently a fall in the pressure difference between the outlet compartment and the inlet compartment, said means for effecting said transient flow including a. means for moderating the rate of said rise in said pressure difference, b. means for moderating said transient flow so that said pressure difference remains greater than a first critical minimum difference for a time interval of less than about 150 milliseconds, said first critical difference being that difference at which a steady flow of gas from said outlet compartment to said inlet compartment just produces a localized spill of granular material from said free surfaces of said first particulate material into said inlet compartment, and c. further means for moderating said transient flow so that said pressure produced by said transient flow peaks to a top value beyond a second critical minimum difference, which is the pressure difference at which a transient flow of gas from said outlet compartment to said inlet compartment producing said pressure difference at said rate of rise just initiates a body movement of said first particulate material toward said free surfaces of this material to spill a portion of this material from said free surfaces, and means for discharging from the inlet compartment material which is spilled thereinto by the body movement means.

8. The gas-solid contactor of claim 7 which said means (b) moderates said transient flow so that said time interval is less than about 50 milliseconds.

9. The gas-solid contactor of claim 7 in which said body-movement means comprise: a source of gas under pressure and means for effecting a sudden discharge of gas from the pressure source into said outlet compartment and volume control means for limiting the quantity of gas discharged into said outlet compartment.

* * * * *